US005735165A

United States Patent [19]

Schockman et al.

[11] Patent Number: 5,735,165

[45] Date of Patent: Apr. 7, 1998

[54] BODYMAKER DRIVE SYSTEM

[75] Inventors: Robert L. Schockman, St. Henry; Roderick A. Lavy, Piqua, both of Ohio

[73] Assignee: The Minster Machine Company

[21] Appl. No.: 493,934

[22] Filed: Jun. 23, 1995

[51] Int. Cl.[6] ..... B21J 9/19; B21J 13/04

[52] U.S. Cl. ..... 72/452.5; 72/347; 72/456

[58] Field of Search ..... 72/347, 452.5, 72/456, 481.2

[56] References Cited

U.S. PATENT DOCUMENTS

| | | | |
|---|---|---|---|
| 3,496,756 | 2/1970 | Smith | 72/432 |
| 3,704,619 | 12/1972 | Paramonoff | 72/349 |
| 3,715,902 | 2/1973 | Fuchs | 72/60 |
| 3,735,629 | 5/1973 | Paramonoff | 72/349 |
| 3,800,583 | 4/1974 | Miller | 72/349 |
| 3,889,509 | 6/1975 | Miller | 72/349 |
| 3,986,382 | 10/1976 | Miller | 72/347 |
| 4,080,819 | 3/1978 | Hook | 72/347 |
| 4,173,138 | 11/1979 | Main | 72/349 |
| 4,435,143 | 3/1984 | Dempsey | 72/452.5 |
| 4,464,924 | 8/1984 | Kralowetz | 72/452 |
| 4,546,636 | 10/1985 | Snyder | 72/346 |
| 4,761,988 | 8/1988 | Kato | 72/452.5 |
| 5,111,679 | 5/1992 | Kobayashi | 72/348 |
| 5,127,256 | 7/1992 | Shiga et al. | 72/452.5 |
| 5,128,877 | 7/1992 | Tang | 364/476 |
| 5,136,875 | 8/1992 | Schockman | 72/452.5 |
| 5,138,922 | 8/1992 | Eigenmann | 72/452.5 |
| 5,272,901 | 12/1993 | Cudzik | 72/347 |
| 5,335,532 | 8/1994 | Mueller et al. | 72/452.5 |

*Primary Examiner*—David Jones

*Attorney, Agent, or Firm*—Randall J. Knuth

[57] ABSTRACT

A mechanical bodymaker drive system for an under drive type vertical punch including a scotch yoke mechanism utilized to drive the punch. Two counterrotating cranks with counterweights are geared together to balance inertial forces on the scotch yoke driven slide. The scotch yoke mechanism, employing a slider block and slide, eliminates second harmonic inertia forces acting on the machine and allows counterrotating counterweights to totally balance inertia forces throughout the stroke. The punch is additionally hydrostatically attached to the scotch yoke mechanisms to compensate for deflections and thermal stress during operation. The hydrostatic pads eliminates the clearance between the face of the punch and the scotch yoke yet permits small lateral movements.

23 Claims, 4 Drawing Sheets

BODYMAKER DRIVE SYSTEM

BACKGROUND OF THE INVENTION

The present invention relates generally to mechanical bodymakers and in particular to metal can producing bodymaker drive mechanisms utilizing a vertical punch.

In prior art drawing presses or bodymakers, the ram is generally oriented horizontally such as in U.S. Pat. No. 3,496,756. The '756 patent utilizes a scotch yoke type mechanism driving a piston horizontally for blanking or drawing container bodies. A disadvantage with this design structure for a bodymaker is that, in punches with longer draws, the end is cantilevered thereby allowing inertial forces and gravity to vary the precision of the cup wall thickness formed thereby. Gravity and vibration act on the cantilevered end forcing the male piston closer to one side of the female tool pack and further away on an opposite side thereby causing cup wall thickness to be thin on one side and thick on an opposite side. It is foreseeable the weight of the punch itself may cause unacceptable changes in cup wall thickness.

U.S. Pat. Nos. 5,272,901 and 3,715,902 show vertical type punches operated by either a combination crankshaft/cam drive system or by hydraulic pressure. These types of presses have unbalanced reciprocating slide inertia forces acting on the machine and their designs do not take into consideration inertial loads or thermal changes acting on the punch affecting the accuracy of the container body produced. These types of structures would create container bodies of questionable accuracy with the currently desired production levels of 400 to 500 cans per minute with and 18 to 24 inch punch stroke length.

The present invention is directed to fill the needs and overcome the aforementioned problems associated with the mechanical bodymaker machines where it is desired to accurately control the punch while the machine is in operation by controlling and counteracting all inertial forces and thus reducing vibratory forces seen by the machine and reflected to the punch.

SUMMARY OF THE INVENTION

The present invention provides an under drive vertical machine with two counterrotating cranks geared together allowing the balance of all the inertial forces acting on the machine. A scotch yoke mechanism is employed to drive the punch eliminating any second harmonic forces and thus properly sized counterrotating counterweights will develop centrifugal forces to balance inertia forces developed by the slide mechanism and attached punches.

Additionally, the punch of the bodymaker hydrostatically floats on the scotch yoke mechanism to account for deflections and thermal changes during operation. The hydrostatic pads preload the face of the punch and keep it square with the scotch yoke slide. The straight line motion of the slide will introduce no lateral forces into the punch.

An advantage of the bodymaker of the present invention is that the side inertia forces are balanced thereby enabling high speed reciprocation. Design speeds of 250 to 500 strokes per minute with a stroke length of 18 to 24 inches are possible with all of the inertial and rotating forces balanced.

Another advantage of the present invention is that the scotch yoke mechanism between the crankshaft and punch creates a pure pushing force on the punch and eliminates second harmonic forces in the bodymaker apparatus thereby allowing the punch to reciprocate in a straighter and more controlled movement. Because of the scotch yoke mechanism all side forces seen by the reciprocating slides are equal and opposite. The scotch yoke mechanism also tends to keeps the overall height of the apparatus down to a minimum for operator convenience.

An additional advantage of the present invention is that by the use of pairs of counterrotating crankshafts, it is possible to balance the internal dynamics of the apparatus thus reducing vibrations and stress.

A further advantage of the present invention is that the punch is hydrostatically attached to the drive mechanism with hydrostatic bearings located between the punch and the drive system. This allows the punch to be preloaded to the slide but still float on a layer of fluid on top of the slide mechanism to allow for thermal changes in the punch and drive mechanism.

The invention, in one form thereof, comprises a bodymaker having a housing in which one or more punches are disposed for vertical reciprocating drawing movement. A crankshaft is rotationally disposed within the housing to which is connected a drive unit to rotate the crankshaft. A scotch yoke mechanism is connected between the crankshaft and the punch to translate rotational movement of the crankshaft into reciprocating movement of the punch whereby lateral forces and deflections seen by the punch are minimized.

In one form of the invention, the scotch yoke mechanism includes a slider block connected to the crankshaft offset from the axis of rotation of the crankshaft. A slide disposed in the housing is constrained to reciprocate in a vertical direction. The punch is attached to the slide while the slider block is connected to the slide so that rotation of the slider block about the crankshaft axis causes the slide to vertically reciprocate.

The invention, in accordance with another aspect thereof, comprises a bodymaker apparatus in which a punch is disposed within a housing for vertical reciprocating drawing movement. A pair of connected counterrotating crankshafts are rotationally disposed within the housing while one of the crankshafts is connected to a drive unit. A scotch yoke mechanism is connected between the pair of crankshafts and the punch to translate rotational movement of the crankshafts into reciprocating movement of the punch. Hydrostatic bearings are disposed between the punch and the slide of the scotch yoke mechanism so that the punch free floats relative to the slide to reduce lateral deflections of the punch.

The invention, in accordance with another aspect thereof, comprises a bodymaker having a punch disposed within the housing for vertical reciprocating drawing movement. A crankshaft is rotatably disposed in the housing attached to a drive unit. A mechanism is connected between the crankshaft and the punch to translate rotational movement of the crankshaft into reciprocating movement of the punch. Hydrostatic pads are disposed between the mechanism and the punch so that the punch free floats relative to the mechanism whereby the punch is permitted to shift due to thermal stress and remain square to the slide.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
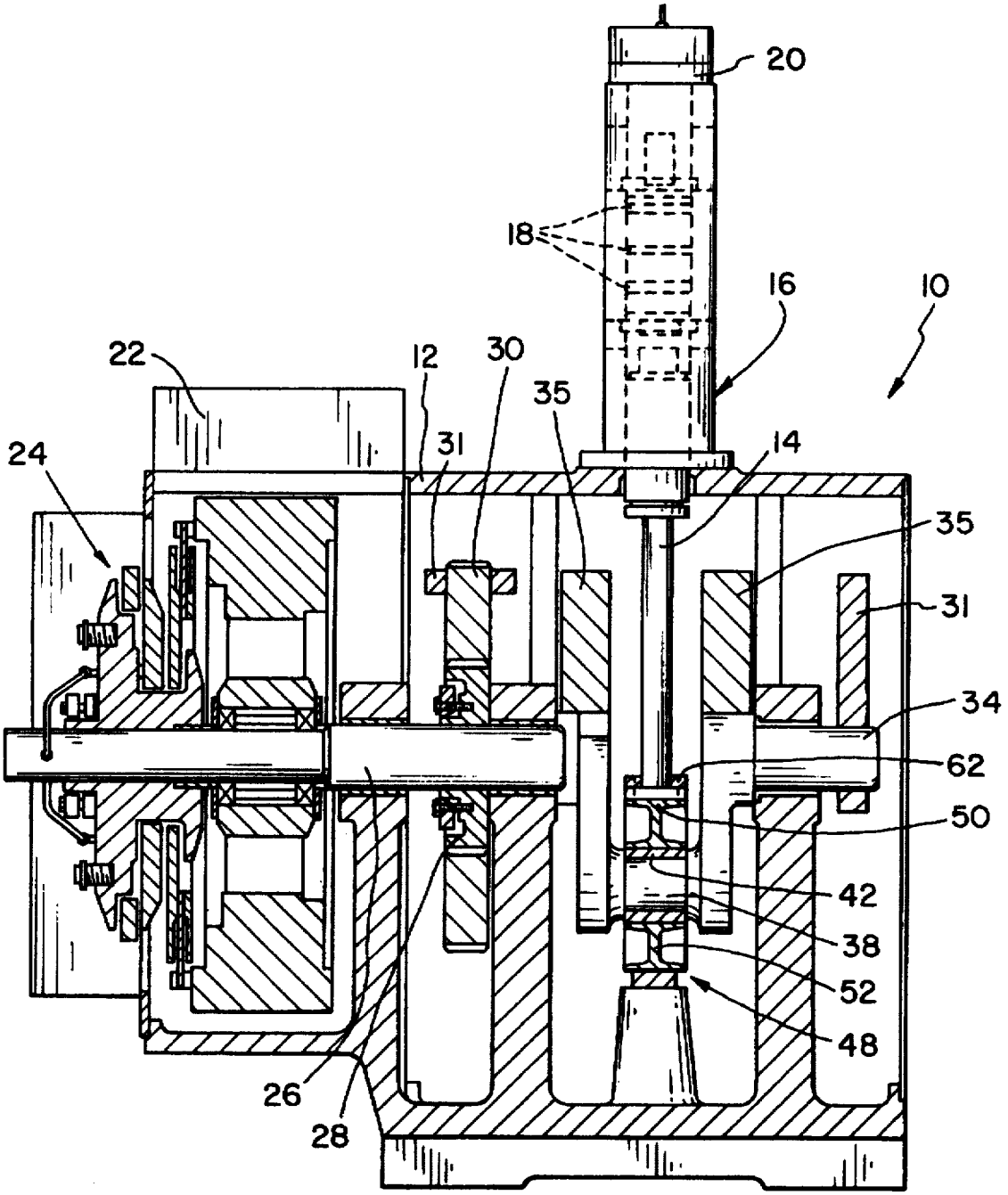
FIG. 1 is a side sectional view of the bodymaker apparatus of the present invention taken along line 1—1 of FIG. 2 and viewed in the direction of the arrows.

Referring now to FIG. 1, a blank forming bodymaker apparatus 10 comprises a housing 12 in which are disposed at least one, but preferably a plurality, of punches 14 oriented for vertical reciprocating drawing movement through a toolpack 16. Toolpack 16 may be of conventional construction having a plurality of ironing rings 18 for use in drawing a cup into a container body. A domer 20 is attached to the top of toolpack 16 for forming one end of the container body formed therein. A drive unit 22, such as an electric motor or other means of creating rotational energy, is drivingly connected to a combination clutch/brake assembly 24 of known construction by a belt or chain (not shown). An example of one type of combination drive/brake assembly is shown in U.S. patent application Ser. No. 08/125,539 owned by the assignee of the present application and explicitly incorporated herein.

Figure 2:
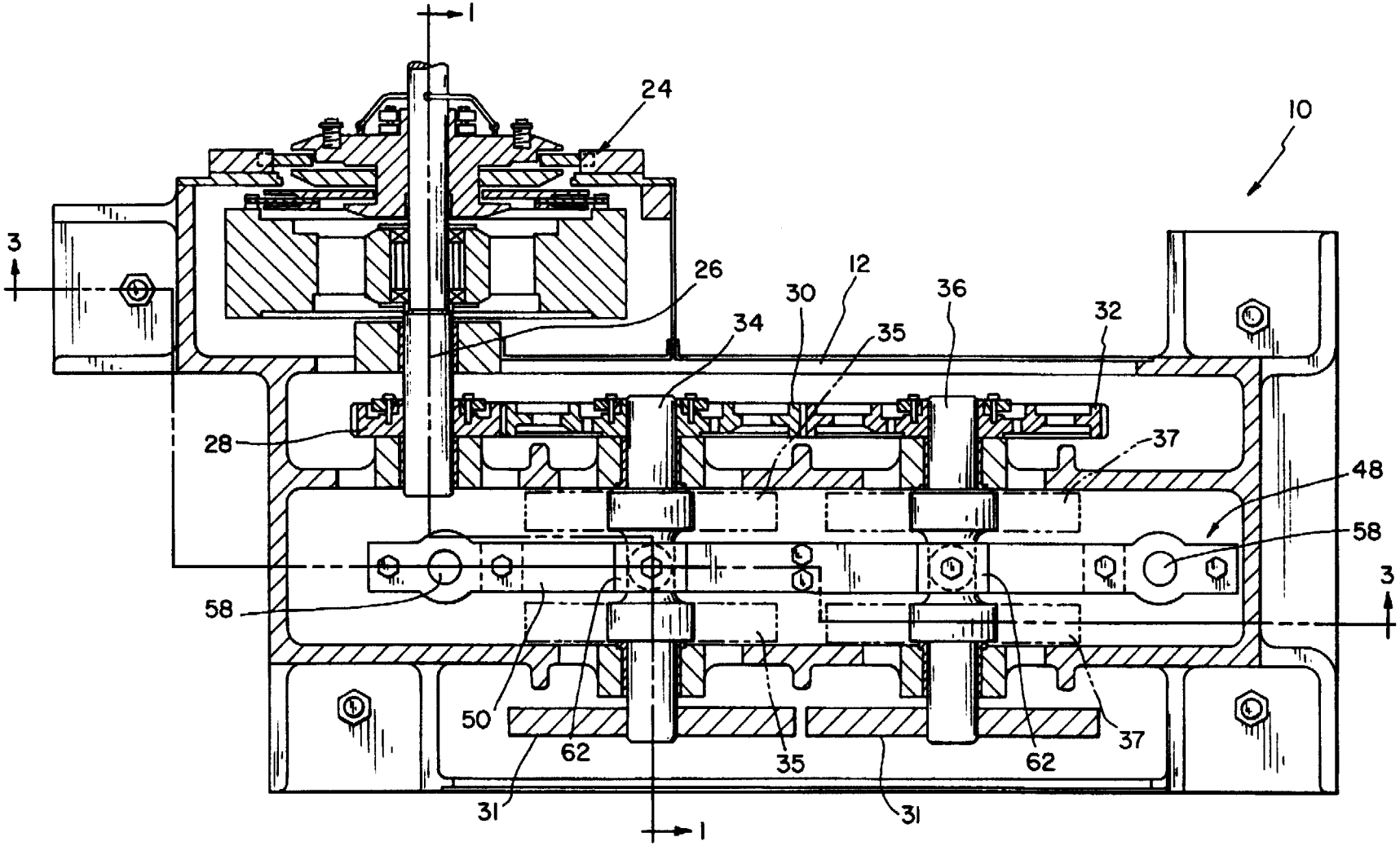
FIG. 2 is a top section view of the bodymaker apparatus of the present invention taken along line 2—2 of FIG. 3 and viewed in the direction of the arrows.

Drive unit 22 is drivingly connected through clutch/brake assembly 24 to a main driveshaft 26 rotationally disposed in housing 12. As shown in FIG. 2, main driveshaft 26 includes a pinion gear 28 which engages counterrotating gears 30 and 32 respectively attached to crankshafts or cranks 34 and 36. Counterrotating crankshafts 34 and 36 are disposed for rotation within housing 12 having an offset portion or arm 38 attached to the scotch yoke mechanism 48 of the present invention.

Figure 3:
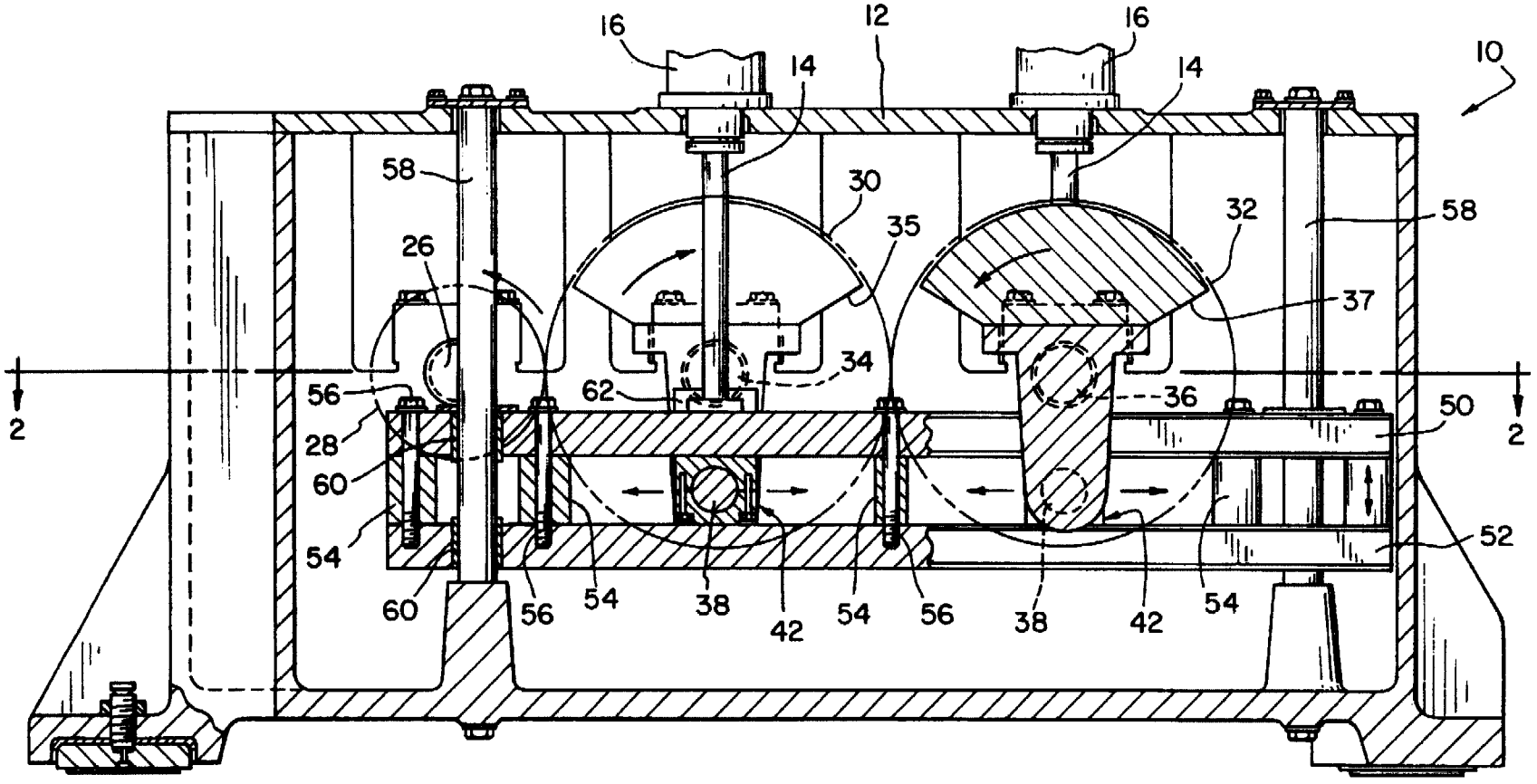
FIG. 3 is a fragmentary sectional view of the bodymaker drive of FIG. 2 taken along line 3—3 and viewed in the direction of the arrows.
Figure 4:
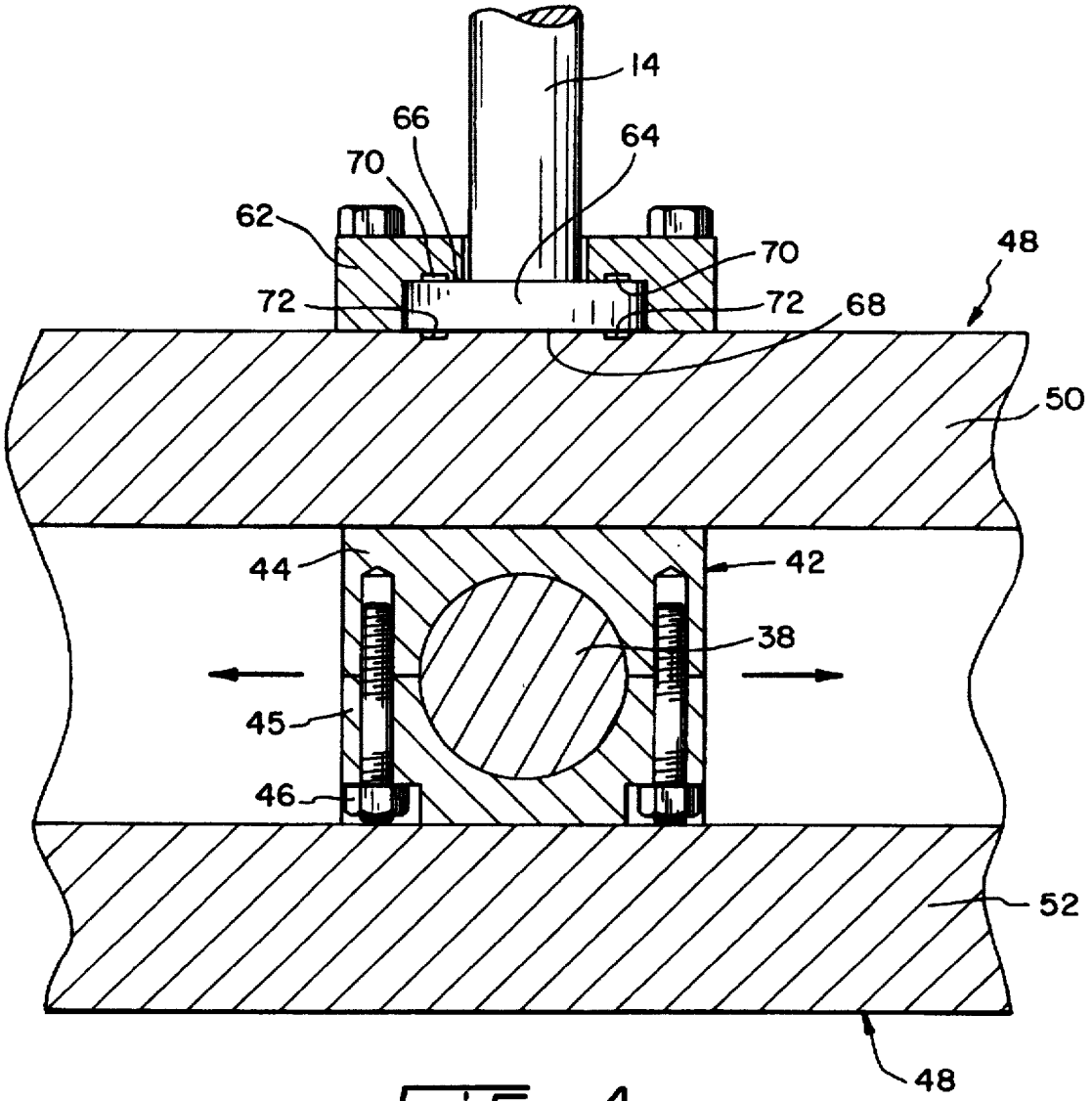
FIG. 4 is an enlarged sectional view of the scotch yoke mechanism of the present invention.

In one aspect of the present invention, a scotch yoke slider block 42 is connected to offset portion 38 of crankshafts 34 and 36. As shown in FIG. 4, slider block 42 is formed of two interfitting members 44 and 45 attached together by bolts 46. The outside surfaces of slider block 42 form together a square or rectangular solid member for sliding movement within a slide assembly 48. Slide assembly 48, in the embodiment shown, includes two rails 50 and 52 spaced apart by a distance substantially equal to the height of slide block 42. As shown in FIG. 3, rails 50 and 52 are spaced apart and connected together by a plurality of spacer blocks 54 through which bolts 56 connect rails 50 and 52 together. Slide assembly 48 is permitted to reciprocate vertically within housing 12 upon a plurality of vertically oriented slide guide posts 58 attached to housing 12.

As shown in FIG. 3, each rail 50 and 52 includes a bushing 60 through which guide post 58 may relatively move. Punches 14 are attached to slide 48 by means of a punch retainer 62 attached to top rail 50. Each punch 14 includes a radially extending circular boss 64 having a ring shaped top surface 66 and a circular bottom surface 68. Retainer 62 fits about punch 14 encircling and enclosing boss 64. Retainer 62 includes a number of recessed pads 70 connected to a source of medium pressure oil and orifices (not shown). Additionally, portions of top rail 50 have similar pads 72 which are likewise connected to a source of medium pressure oil and orifices. Pads 70 and 72, when filled with pressurized oil and connected to properly sized orifices, act as hydrostatic pockets forming a hydrostatic bearing. As shown in FIG. 4, the hydrostatic bearing formed by grooves 70, 72 and disposed between punch 14 and slide 48 effectively preloads punch 14 to slide assembly 48.

As shown in FIGS. 2 and 3, counterweights 35 and 37 are attached to each crank offset arm 38 of crankshafts 34 and 36, respectively, for balancing the crank throw and slider block 42. Additional counterweights 31 are attached to counterrotating gears 30 and 32 and/or crankshafts 34 and 36 to balance-the slide inertia forces of the slide assembly 48.

Although the present invention shows two crankshafts or cranks 34 and 36 with two associated punches 14, it is foreseen that to increase machine 10 output, additional crankshafts and punches may be attached. To ensure balance of all forces, additional crankshafts 34 must preferably be combined in counterrotating pairs.

In operation, drive unit 22, through the use of a combination drive/brake assembly 24, will cause crankshafts 34 and 36 to rotate via power transferred from main driveshaft 26 through pinion gear 28 to counterrotating gears 30 and 32. Rotation of crankshafts 34 and 36 will cause the offset arm or portion 38 of each crank to rotate about the center line of each crankshaft 34 and 36° This rotation will be converted by each slider block 42 into horizontal reciprocating movement between and relative rails 50 and 52 of slide 48. As slide bock 42 horizontally reciprocates within slide 48, slide 48 will likewise be forced to undergo vertical reciprocating movement based on the vertical component of the rotation of offset portion 38. Slide 48 will be guided for vertical reciprocating movement upon guide posts 58.

Punches 14, attached by means of punch retainers 62 to slide 48, will likewise undergo vertical reciprocating movement into and out of a container toolpack 16.

Use of a scotch yoke mechanism eliminates second harmonic forces caused by the particularly long throw of crankshafts 34 and 36. Additionally, the counterrotating counterweights attached to crankshafts 34 and 36 balance out the reciprocating inertia seen by bodymaker 10. In a vertically reciprocating punch 14, as compared to prior art horizontal mountings, a balance of all lateral forces acting on the punch may be obtained throughout full speed range of machine. The hydrostatic bearings created within oil fill grooves 70 and 72 allow the punch to hydrostatically float above top rail 50 of slide 48. The straight line motion of slide 48 introduces no lateral forces into the punch. This floating permits slight movement of punch 14 to limit slide deflections and account for thermal stress inherent in the system at operation speeds between 250 and 500 or more reciprocations per minute.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blank forming metal can bodymaker apparatus comprising:

a housing;

a punch disposed within said housing for vertically upward reciprocating drawing movement;

at least one crankshaft rotationally disposed in said housing, said crankshaft having an axis of rotation;

a drive unit drivingly connected to said crankshaft, said drive unit including at least two counterrotating drive members each having a counterweight thereon; and a scotch yoke mechanism connected between said crankshaft and said punch, said counterweights balancing inertial forces created by said scotch yoke mechanism and said punch, said scotch yoke mechanism translating rotational movement of said crankshaft into reciprocating movement of said punch, whereby lateral deflections of said punch are minimized.

2. The bodymaker of claim 1 in which said scotch yoke mechanism includes a slider block connected to said crankshaft and offset from its axis of rotation, a slide constrained to reciprocate in a vertical direction, said punch attached to said slide, said slider block connected to said slide so that motion of said slider block about said axis causes said slide to vertically reciprocate.

3. The bodymaker of claim 2 in which said slide includes two horizontal rails, said slider block is disposed and guided between said two rails whereby said slider block is constrained to horizontal movement relative said slide.

4. The bodymaker of claim 2 in which a plurality of hydrostatic bearings are disposed between said punch and said slide whereby said punch free floats relative said slide to reduce lateral deflections of said punch.

5. The bodymaker of claim 1 in which a plurality of hydrostatic bearings are disposed between said punch and said slide whereby said punch free floats relative said slide to reduce lateral deflections of said punch.

6. The bodymaker of claim 1 wherein said conterrotating drive members are intermeshed gears.

7. The bodymaker apparatus of claim 1 including a second shaft counterrotating relative to said crankshaft, said crankshaft and second shaft having counterweights thereon that balance inertia forces created by said scotch yoke mechanism and punch.

8. A blank forming metal can bodymaker apparatus comprising:

a housing;

a punch disposed within said housing for vertically upward reciprocating drawing movement;

a pair of connected counterrotating crankshafts rotationally disposed in said housing, each said crankshaft having an axis of rotation;

a drive unit drivingly connected to at least one of said crankshafts;

a scotch yoke mechanism connected between said pair of crankshafts and said punch to translate rotational movement of said crankshafts into reciprocating movement of said punch, each said crankshaft having a counterweight thereon that balances inertia forces and lateral deflections of said punch.

9. The bodymaker of claim 8 in which said scotch yoke mechanism includes a slider block connected to each said crankshaft and offset from its respective axis of rotation, a slide constrained to reciprocate in a vertical direction, said punch attached to said slide, said slider blocks connected to said slide so that rotation of said slider blocks about each respective said axis causes slide to vertically reciprocate.

10. The bodymaker of claim 9 in which said slide includes two horizontal rails, each said slider block disposed and guided between said two rails whereby each said slider block is constrained to horizontal movement relative said slide.

11. The bodymaker of claim 10 in which a plurality of hydrostatic bearings are disposed between said punch and said slide whereby said punch free floats relative said slide to reduce lateral deflections of said punch.

12. The bodymaker of claim 9 in which a plurality of hydrostatic bearings are disposed between said punch and said slide whereby said punch free floats relative said slide to reduce lateral deflections of said punch.

13. The bodymaker of claim 8 including a plurality of said punches.

14. The bodymaker of claim 13 in which said punches are each in vertical alignment with respective crankshafts.

15. The bodymaker of claim 8 in which a plurality of hydrostatic bearings are disposed between said punch and said scotch yoke mechanism whereby said punch freefloats relative to said scotch yoke mechanism to reduce lateral deflections of said punch.

16. The bodymaker apparatus of claim 8 wherein said drive unit comprises a pair of counterrotating drive members each having a counterweight thereon, said counterweights further balancing inertia forces created by said scotch yoke mechanism and said punch.

17. The bodymaker apparatus of claim 16 wherein said counterrotating drive members are intermeshed gears.

18. The bodymaker apparatus of claim 16 wherein said crankshafts are supported in bearings, and including a further counterweight mounted on each of said crankshafts outboard of said bearings.

19. A blank forming metal can bodymaker apparatus comprising:

a housing;

a punch disposed within said housing for reciprocating vertically upward drawing movement;

a pair of crankshafts rotationally disposed in said housing, said crankshafts each having an axis of rotation;

a drive unit connected to said crankshafts to rotate said crankshafts in opposite directions;

a drive mechanism connected between said crankshafts and said punch to translate rotational movement of said crankshafts into reciprocating movement of said punch; and hydrostatic pads disposed between said mechanism and said punch so that said punch free floats relative to said mechanism whereby said punch is permitted to shift due to thermal changes and remain square to said drive mechanism.

20. The bodymaker of claim 19 in which said drive mechanism is of the scotch yoke type.

21. The bodymaker of claim 20 in which said scotch yoke mechanism includes a slider block connected to said crankshaft and offset from its axis of rotation, a slide constrained to reciprocate in a vertical direction, said punch attached to said slide, said slider block connected to said slide so that rotation of slider block about said axis causes slide to vertically reciprocate.

22. The bodymaker of claim 19 including a plurality of said punches.

23. The bodymaker of claim 22 in which said punches are each in alignment with respective said crankshafts.

* * * * *